US008132933B2

(12) United States Patent
Chao

(10) Patent No.: US 8,132,933 B2
(45) Date of Patent: Mar. 13, 2012

(54) POWER BLACKOUT BULB

(76) Inventor: Albert Chao, Saddle River, NJ (US)

( * ) Notice: Subject to any disclaimer, the term of this patent is extended or adjusted under 35 U.S.C. 154(b) by 90 days.

(21) Appl. No.: 12/854,410

(22) Filed: Aug. 11, 2010

(65) Prior Publication Data

US 2012/0039063 A1 Feb. 16, 2012

(51) Int. Cl.
*F21L 4/00* (2006.01)
*F21L 13/00* (2006.01)

(52) U.S. Cl. ..... 362/183; 362/640; 362/650; 362/20; 315/119; 315/121

(58) Field of Classification Search ..... 362/20, 362/640, 50, 183, 192, 147; 315/291, 119, 315/121, 122; 340/463, 468
See application file for complete search history.

(56) References Cited

U.S. PATENT DOCUMENTS 7,476,002 B2 * 1/2009 Wolf et al. ..... 362/231
7,481,556 B2 * 1/2009 Yarrington ..... 362/255
2002/0089420 A1 * 7/2002 Martineau et al. ..... 340/463
2007/0091598 A1 * 4/2007 Chen ..... 362/231
2010/0244568 A1 * 9/2010 Chandler et al. ..... 307/66
2011/0133655 A1 * 6/2011 Recker et al. ..... 315/159
2011/0163668 A1 * 7/2011 Jonsson ..... 315/51

* cited by examiner

*Primary Examiner* — Ali Alavi

(74) *Attorney, Agent, or Firm* — Notaro, Michalos & Zaccaria P.C.

(57) ABSTRACT

A blackout light bulb has a housing with an Edson screw at one end for screwing into a light fixture socket and a plurality of spaced apart LEDs mounted to its opposite end. A flexible stalk is connected to the housing between the Edison screw and the LEDs and can be bent into a selected shape for positioning a free end of the stalk as desired. A circuit board in the housing has an electronic circuit connected to the Edison screw, to the LEDs and to a photo cell at the free end of the stalk. A rechargeable battery in the housing is connected to the circuit board so that it is charged under certain normal conditions and so that it lights up the LEDs under other blackout conditions.

7 Claims, 5 Drawing Sheets

POWER BLACKOUT BULB

FIELD AND BACKGROUND OF THE INVENTION

The present invention relates generally to the field of lighting, and in particular to new and useful power blackout bulb that has an Edison screw to be screwed into a conventional Edison light socket, for example the standard socket in high-hat lighting fixtures.

The designation Exx is used to identify various Edison screws in common use today and refers to the diameter of the screw in millimeters. For example, an E12 Edison screw has a diameter of 12 mm. There are four common sizes of screw-in sockets used for line-voltage lamps: candelabra—E12 in North America and E11 in Europe; intermediate—E17 in North America and E14 (SmallES) in Europe; medium or standard—E26 (MES) in North America and E27 (ES) in Europe; and mogul—E39 in North America and E40 (GoliathES) in Europe.

Standard incandescent filament light bulbs that us the standard Edison screws are slowly being replaced by Compact Fluorescent Lights (CFL) and Light Emitting Diode (LED) bulbs that use the same screws so that they can fit in the same sockets, but use much less energy and are longer lasting as well.

Go to: http://eartheasy.com/live_energyeff_lighting.htm for a comprehensive explanation of the advantages of CFL and LED bulbs.

Light responsive light fixtures are known that use photo cells that sense the ambient light to active the fixture when the ambient light is low in order to illuminate an area at such times. Emergency lights are also know that sense a blackout or power failure condition illuminate are area at such time.

SUMMARY OF THE INVENTION

It is an object of the present invention to provide an emergency or blackout light that replaces one of the standard screw-in bulbs in an Edison screw socket in an area, the emergency light operating during normal periods when power is being suppled to the socket to charge a battery or other electric power storage element in the bulb, and when a sensor in the bulb senses that there is little or no ambient light and that there is also no power, e.g. because of a black-out condition, powers one or more LEDs in the bulb to illuminate the area. During low light conditions with power on, the blackout light's circuit continues to charge the battery or other power storage element like a capacitor (collectively called a battery herein for simplicity) and at the same time supplies a lower current to the LEDs for low illumination of the area.

Another object of the invention is to provide a blackout light bulb having a housing with an Edson screw at one end for screwing into a light fixture socket and a plurality of spaced apart LEDs mounted to its opposite end, with a flexible stalk connected to the housing between the Edison screw and the LEDs that can be bent into a selected shape for positioning a free end of the stalk as desired. A circuit board in the housing has an electronic circuit connected to the Edison screw, to the LEDs and to a photo cell at the free end of the stalk. A rechargeable battery in the housing is connected to the circuit board so that it is charged under certain normal conditions, and so that it lights up the LEDs under blackout conditions.

According to another object of the invention the circuit includes components for executing a first mode of operation during a high ambient light condition when the photo cell sends a first signal and AC power is being supplied by the Edison screw for charging the battery; a second mode of operation during an intermediate ambient light condition, when power is supplied to the socket, the photo cell sending a second signal to partly light the LED and charge the battery; a third mode of operation during a high ambient light condition with no power supplied to the socket, the photo cell sending the first signal and not lighting the LEDs and not charging the battery; and a fourth mode of operation during a low ambient light condition and no power supplied to the socket, the photo cell sending a third signal for fully lighting the LEDs until the battery is exhausted.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
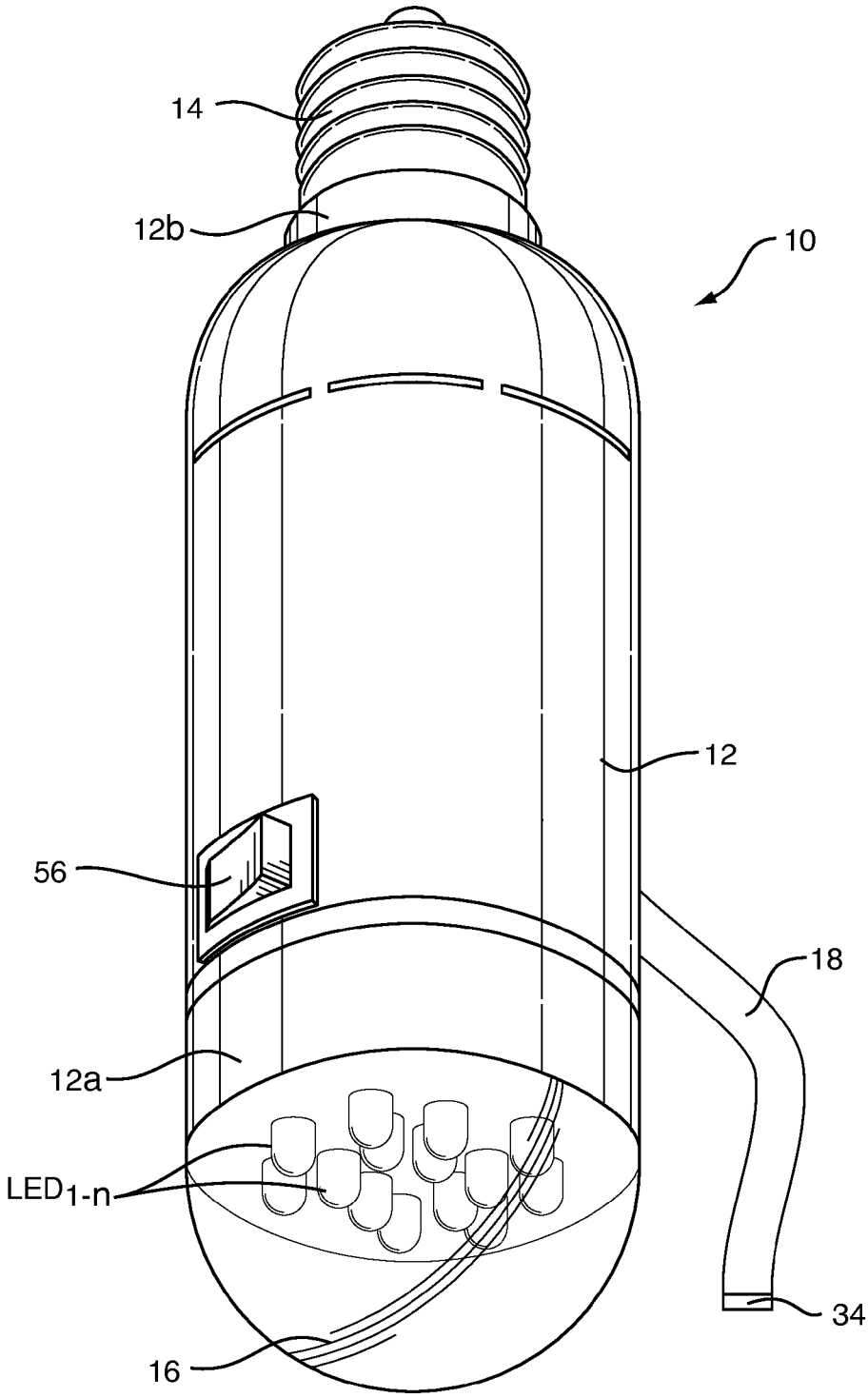
FIG. 1 is a perspective view of the blackout bulb of the invention.
Figure 2:
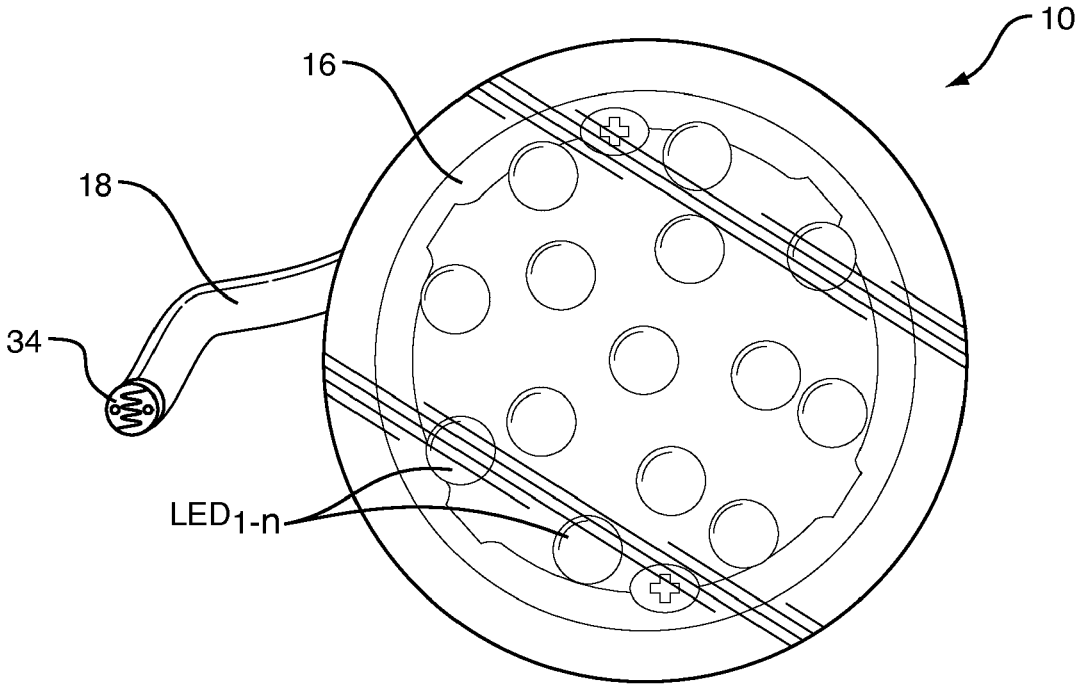
FIG. 2 is bottom plan view thereof.

Referring now to the drawings, in which like reference numerals are used to refer to the same or similar elements, FIGS. 1 and 2 show a blackout light bulb 10 that comprises a generally cylindrical housing 12 having an illumination end 12*a* and a base end 12*b*. An Edson screw 14 such as an E26 screw, is connected to the base end 12*b* of the housing 12 for screwing into a light fixture socket 100 of a light fixture such as a high hat fixture 110 shown in FIGS. 4A and 4B.

The invention includes a flexible stalk 18 having a first end connected to the housing 12 at a location about half way between the illumination end 12*a* and the base end 12*b* of the housing 12. The flexible stalk 18 has an opposite free end that carries a photo cell 34 thereat, and the stalk itself is bendable into and holds any selected shape so that the free end of the stalk and therefore its photo cell can be positioning at any selected location with respect to the illumination end of the housing 12. The inventor has found that by placing this free and its attached photo cell 34 near an outer rim 132 of the high hat fixture 110 as shown in FIGS. 4A, 4B and 5, the correct amount of ambient light reaches the photo cell, without being confused by or causing an undesired feedback condition by light coming from the LEDs mounted at the illumination end of the bulb 10 or from other sources.

Figure 4A:
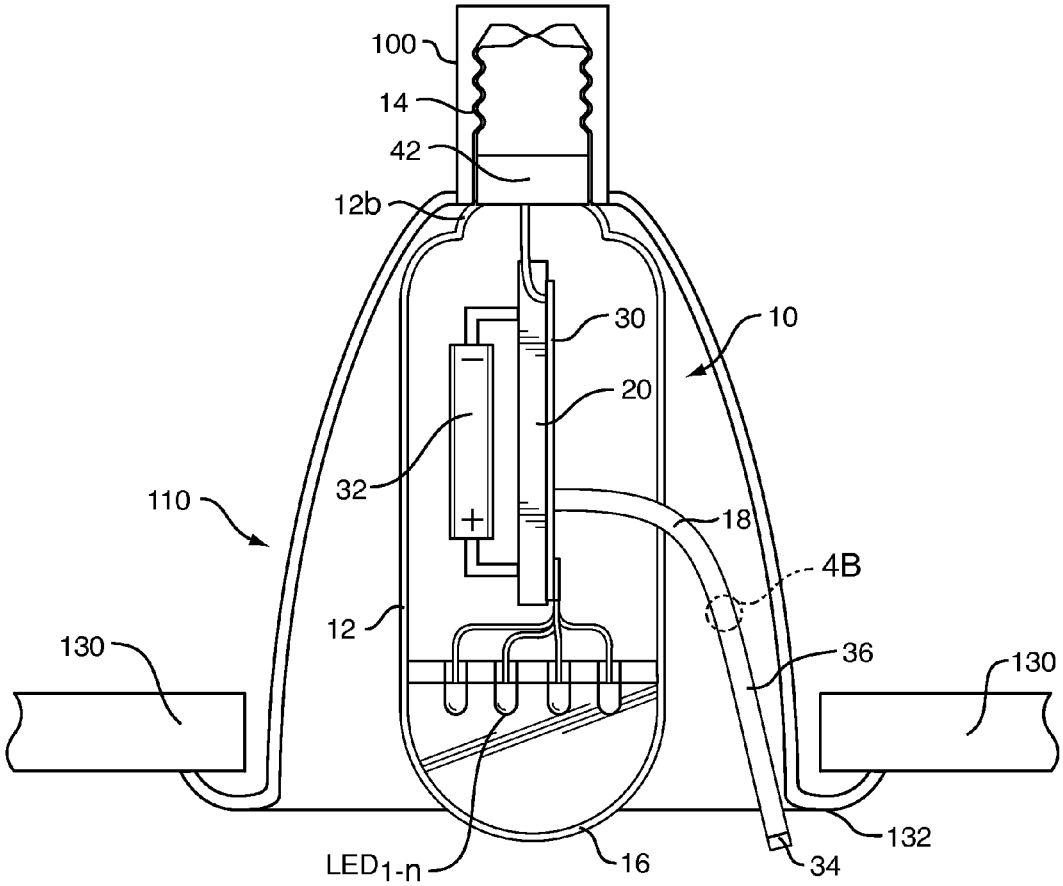
FIG. 4A is a sectional view of the blackout bulb of the invention in a high hat lighting fixture.
Figure 4B:
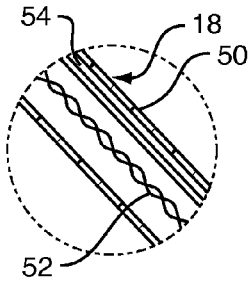
FIG. 4B is an enlarged detail marked 4B in FIG. 4A.
Figure 5:
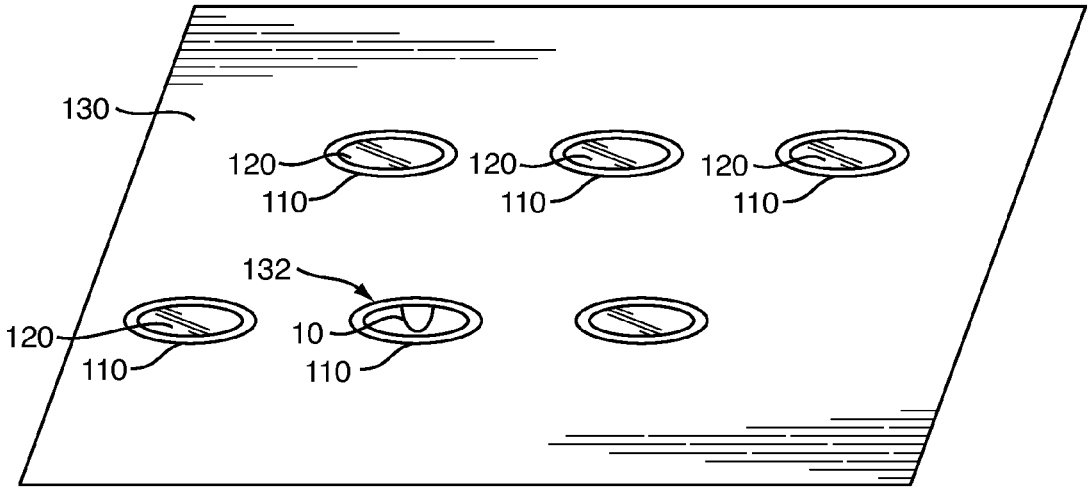
FIG. 5 is a schematic view of an area of ceiling with multiple high hat fixtures, one of which is provided with the blackout light bulb of the invention.

As also shown in FIG. 4A, an electronic circuit board 20 with an electronic circuit 30 thereon, is mounted in the housing 12 and is electrically connected by wires 42 to the known contact sections of the Edison screw, for receiving AC power from the Edison screw when it is screwed into a light fixture socket 100 to which power is being supplied, such as 110 volts of AC power that is conventional in North America.

Returning to FIGS. 1 and 2, a plurality of spaced apart LEDs, $LED_1$ to $LED_n$ are mounted to the illumination end 12*a* of the housing, under a clear plastic dome 16 fixed, e.g. by permanent adhesive cement, around the perimeter of the base 12*a*. The circuit board 20 shown in FIG. 4A as well, is mounted in the housing and its circuit 30 is electrically connected to a rechargeable battery 32 that is mounted in the housing. The circuit 30 has components that operate to create a plurality of operating modes, at least one of the modes being for supplying electrical power for charging the battery 32 and at least one other one of the modes being for supplying electrical power from the charged battery 32 to the circuit for lighting the LEDs during a blackout condition.

Figure 3:
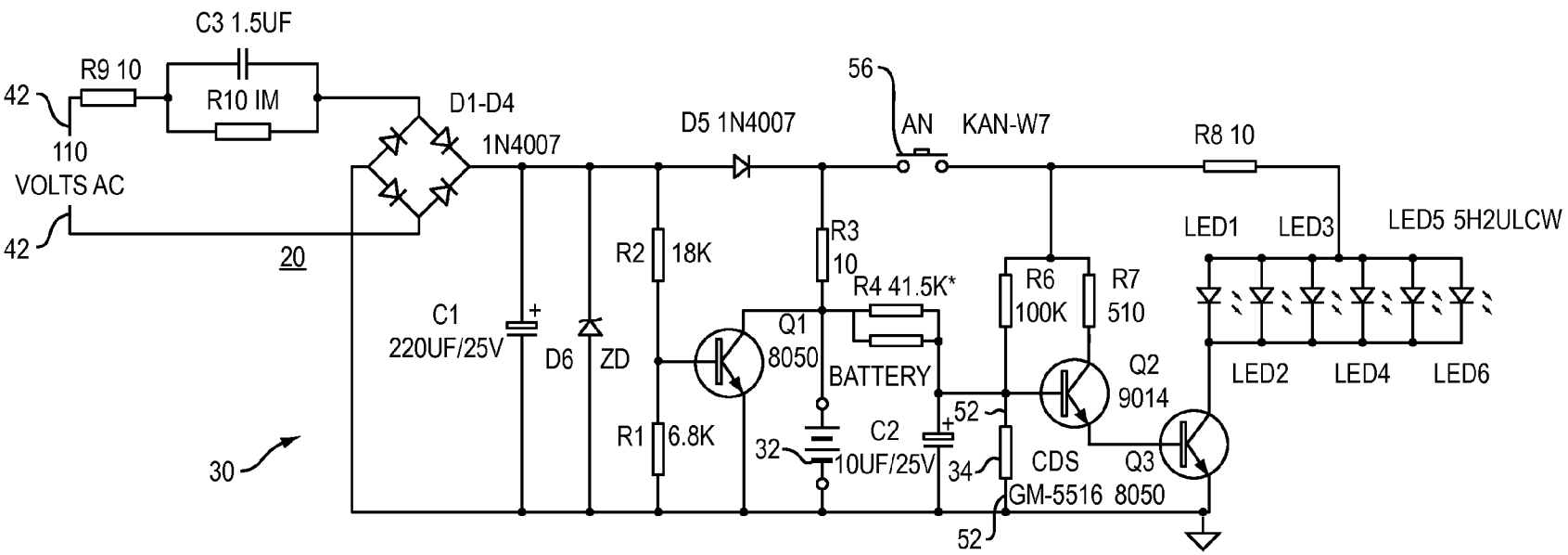
FIG. 3 is a circuit diagram of the circuit in the blackout bulb of the invention.

With reference to FIG. 3, the photo cell 34 mounted at the free end of the stalk 18 and electrically connected to the circuit 30 by wires 52, sends a first, low resistant signal to the circuit under a first high ambient light condition such as when there is day light, a second, medium resistance signal to the circuit under a second intermediate ambient light condition such as when other lighting is on from other light fixtures in the same area, and a third, high resistance signal to the circuit under a third low ambient light condition such as a night.

As will be explained in greater detail below, the circuit 30 includes conventional electronic components for executing: a first mode of operation during the first high ambient light condition when the photo cell sends the first signal and AC power is being supplied by the Edison screw 14 for charging the battery; a second mode of operation during the second intermediate ambient light condition when power is being supplied to the socket, the photo cell sending the second signal to partly light the LED and charge the battery 32; a third mode of operation during a first high ambient light condition with no power supplied to the socket when the photo cell sends the first signal for not lighting the LEDs and not charging the battery; and a fourth mode of operation during the third low ambient light condition and no power supplied to the socket when the photo cell sends the third signal for fully lighting the LEDs to act as a blackout light of area until the battery is exhausted.

High hat fixtures 110 that are also called hi-hat fixtures, are most often used in groups as shown, for example, in FIG. 5, to illuminate an area of a house, office or other area, such as a family room or hallway. According to the invention, one high hat 110 in the group on a ceiling 130 is provided with the screw-in blackout bulb 10 of the invention so as to illuminate the area under the ceiling during a blackout period when there is no other ambient light available such as at night. The remaining high hats 110 contain conventional light bulbs 120, such as flood or spot light bulbs for illuminating the area during normal times when light is needed.

FIG. 3 illustrates the circuit 30 on circuit board 20 mounted in the bulb housing 12. When the 10 bulb of the invention is screwed into the standard Edison socket 100 of the high hat ceiling fixture 110 and a wall switch is closed to supply power to the socket, 110 Volt AC current goes through capacitor C3 though a rectifying bridge D1-D4 to a diode D6 and the power is reduced to 4.3 volts.

As discuses generally above, the circuit 30 is designed to accommodate four situations by containing conventional electrical components that are connect to operate as follows.

A. During day time hours with the power on, the photo cell 34 senses the higher ambient light level and its resistance will become lower so the current is block by transistor Q3 and therefore the LEDs LED1 to LED6 will not light. The battery 32 is charged up to, e.g. 3.7 volts maximum during this time.

B. At night with the power on since the photo cell 34 senses no light or minimum light, the resistance will become higher and current will go through Q1, R3, R4 and Q3 at a low rate and make the LEDs partially light up. The battery will discharge power but maintain at 3.7 volts.

C. During the day (i.e. a high ambient light condition) but with a power blackout condition (i.e. no power to the light fixture socket), since the photo cell 34 senses light, it blocks Q3 and the LEDs will not lite. The battery 32 will also not be charged or discharged.

D. At night time (i.e. low or not light condition) with a power blackout, due to the photo cell 34 sensing no light or minimum light, the resistance will become higher, block transistor Q1 and current will go through R3, R4, Q2 and Q3 so that the LEDs LED1 to LED6 will light up at their maximum until the battery 32 is exhausted, which the inventor has found to be several hours on an initially fully charged battery 32.

In the circuitry, Q1 plays a major role to control the light intensity during power on/off. The photo cell 32 identifies day and night. Using a 3.2 volt lithium battery 32 can prolong the life time of the product up to 5 years.

Although 6 LEDs are shown in the circuit 30 and 14 in FIG. 3, any number of LEDs can used that can be accommodated by the circuit 30 and the battery 32. Advantageously the blackout bulb of the invention has about 6 to 8 LEDs and can last three to four days without recharging.

Circuit 30 also has a master switch 56 for completely deactivating all battery charging and LED functions. Switch 56 is open primarily for periods of transport and storage. Before the blackout bulb 10 is to be screwed into its high hat fixture 110 for use, the switch 56 is closed and left closed for the duration of the bulbs use.

Returning to FIGS. 4A and 4B, the stalk 18 as shown in the enlargement FIG. 4B, has a outer flexible plastic sheath 50, made for example of heat shrinking material, that contains a pair of wires 52 that connect the photo cell 34 to the circuit 30, and a length of flexible, repeatedly bendable metal or plastic 54, that can be bend into any desired shape and that keeps that shape so that the photo cell 34 can be placed near the perimeter 132 of the high hat 110. Soldering wire has been found to be a good candidate for the bendable material 52.

While a specific embodiment of the invention has been shown and described in detail to illustrate the application of the principles of the invention, it will be understood that the invention may be embodied otherwise without departing from such principles.

What is claimed is:

1. A blackout light bulb comprising:

a housing having an illumination end base end;

an Edson screw connected to the base end of the housing for screwing into a light fixture socket;

a plurality of spaced apart LEDs mounted to the illumination end of the housing;

a flexible stalk having a first end connected to the housing at a location between the illumination end and the base end of the housing, the flexible stalk having an opposite free end and being bendable into and holding a selected shape for positioning the free end at a selected location with respect to the illumination end of the housing;

a circuit board mounted in the housing;

an electronic circuit mounted to the circuit board and electrically connected to the Edison screw for receiving AC power from the Edison screw when a light fixture socket to which the Edison screw is screwed is being supplied with AC power;

a rechargeable battery mounted in the housing and electrically connected to the circuit board, the circuit having a plurality of operating modes, at least one of said modes being for supplying electrical power for charging the battery and at least one of said modes being for supplying electrical power from the battery to the circuit;

a photo cell mounted at the free end of the stalk and electrically connected to the circuit for sending a first signal to the circuit under a first high ambient light condition, a second signal to the circuit under a second intermediate ambient light condition, and a third signal to the circuit under a third low ambient light condition; and the circuit including components for executing:

a first mode of operation during a first high ambient light condition when the photo cell sends the first signal and AC power is being supplied by the Edison screw for charging the battery;

a second mode of operation during a second intermediate ambient light condition, and power supplied to the socket, the photo cell sends the second signal to partly light the LED and charge the battery;

a third mode of operation during a first high ambient light condition with no power supplied to the socket, the photo cell sends the first signal for not lighting the LEDs and not charging the battery; and a fourth mode of operation during a third low ambient light condition and no power supplied to the socket, the photo cell sends the third signal for fully lighting the LEDs.

2. The blackout light bulb of claim 1, wherein the stalk comprises an outer flexible sheath containing a pair of wires for connecting the photo cell to the circuit and a length of flexible, repeatedly bendable material that can be bend into any desired shape and that keeps that shape so that the photo cell can be placed at the selected location.

3. The blackout light bulb of claim 1, wherein the stalk comprises an outer flexible plastic sheath of heat shrink material containing a pair of wires for connecting the photo cell to the circuit and a length of flexible metal, repeatedly bendable material that can be bend into any desired shape and that keeps that shape so that the photo cell can be placed at the selected location.

4. A blackout light bulb comprising:

a housing with an Edson screw at one end for screwing into a light fixture socket;

a plurality of spaced apart LEDs mounted to an opposite end of the housing;

a flexible stalk connected to the housing between the Edison screw and the LEDs for bent into a selected shape for positioning a free end of the stalk at a selected location;

a light sensor cell connected at the free end of the flexible stalk;

a circuit board in the housing with an electronic circuit connected to the Edison screw, to the LEDs and to the light sensor cell;

a rechargeable battery in the housing connected to the circuit board; and a plurality of electronic components in the circuit connected so that the battery is charged under certain normal conditions sensed by the light sensor cell and so that the battery lights up the LEDs under other blackout conditions sensed by the light sensor cell.

5. The blackout light bulb of claim 4, wherein the stalk comprises an outer flexible plastic sheath containing a pair of wires for connecting the photo cell to the circuit and a length of flexible, repeatedly bendable material that can be bend into any desired shape and that keeps that shape so that the photo cell can be placed at the selected location.

6. The blackout light bulb of claim 4, wherein the stalk comprises an outer flexible plastic sheath of heat shrink material containing a pair of wires for connecting the photo cell to the circuit and a length of flexible metal, repeatedly bendable material that can be bend into any desired shape and that keeps that shape so that the photo cell can be placed at the selected location.

7. A blackout light bulb comprising:

a housing having an illumination end base end;

an Edson screw connected to the base end of the housing for screwing into a light fixture socket;

a plurality of spaced apart LEDs mounted to the illumination end of the housing;

a circuit board mounted in the housing;

an electronic circuit mounted to the circuit board and electrically connected to the Edison screw for receiving AC power from the Edison screw when a light fixture socket to which the Edison screw is screwed is being supplied with AC power;

a rechargeable battery mounted in the housing and electrically connected to the circuit board, the circuit having a plurality of operating modes, at least one of said modes being for supplying electrical power for charging the battery and at least one of said modes being for supplying electrical power from the battery to the circuit;

a photo cell mounted at the housing and electrically connected to the circuit for sending a first signal to the circuit under a first high ambient light condition, a second signal to the circuit under a second intermediate ambient light condition, and a third signal to the circuit under a third low ambient light condition; and the circuit including components for executing:

a first mode of operation during a first high ambient light condition when the photo cell sends the first signal and AC power is being supplied by the Edison screw for charging the battery;

a second mode of operation during a second intermediate ambient light condition, and power supplied to the socket, the photo cell sends the second signal to partly light the LED and charge the battery;

a third mode of operation during a first high ambient light condition with no power supplied to the socket, the photo cell sends the first signal for not lighting the LEDs and not charging the battery; and a fourth mode of operation during a third low ambient light condition and no power supplied to the socket, the photo cell sends the third signal for fully lighting the LEDs until the battery is exhausted.

* * * * *